US009790685B2

(12) United States Patent
Brandt et al.

(10) Patent No.: US 9,790,685 B2
(45) Date of Patent: Oct. 17, 2017

(54) INTERLOCK PANEL, PANEL ASSEMBLY, AND METHOD FOR SHIPPING

(71) Applicant: BARRETTE OUTDOOR LIVING, INC., Middleburg Heights, OH (US)

(72) Inventors: Jeffrey R. Brandt, Millersport, OH (US); Kevin T. Burt, Columbus, OH (US)

(73) Assignee: BARRETTE OUTDOOR LIVING, INC., Middleburg Heights, OH (US)

( * ) Notice: Subject to any disclaimer, the term of this patent is extended or adjusted under 35 U.S.C. 154(b) by 0 days.

(21) Appl. No.: 14/324,944

(22) Filed: Jul. 7, 2014

(65) Prior Publication Data

US 2015/0033659 A1 Feb. 5, 2015

Related U.S. Application Data

(63) Continuation of application No. 11/388,775, filed on Mar. 24, 2006, now Pat. No. 8,769,904.
(Continued)

(51) Int. Cl.

| | |
|---|---|
| ***E04B 5/02*** | (2006.01) |
| ***E04C 2/40*** | (2006.01) |
| ***E04F 15/02*** | (2006.01) |
| ***E04F 15/10*** | (2006.01) |
| ***E04B 2/02*** | (2006.01) |

(Continued)

(52) U.S. Cl.
CPC ..... *E04C 2/40* (2013.01); *E04B 2/02* (2013.01); *E04C 2/38* (2013.01); *E04C 2/46* (2013.01); *E04F 13/07* (2013.01); *E04F 13/0894* (2013.01); *E04F 15/02038* (2013.01); *E04F 15/105* (2013.01); *E04H 17/16* (2013.01); *E04B 2002/0202* (2013.01); *E04F 2201/0115* (2013.01)

(58) Field of Classification Search
CPC ..... E04F 15/04; E04F 15/02005; E04F 15/02038; E04F 13/07; E04F 13/0894; E04F 15/105; E04F 2201/0115; E04B 1/6158; E04B 2/02; E04B 2002/0202; E04C 2/40; E04C 2/38; E04C 2/46; E04H 17/16
USPC ..... 52/177, 580, 586.1, 586.2, 588.1, 592.1
See application file for complete search history.

(56) References Cited

U.S. PATENT DOCUMENTS 3,460,304 A 8/1969 Braeuninger et al.
5,102,253 A * 4/1992 Pugliesi-Conti et al. ..... 403/5
(Continued)

OTHER PUBLICATIONS

Webpages, www.structurepvc.com, printed May 17, 2005, 8 pages.
(Continued)

*Primary Examiner* — William Gilbert
(74) *Attorney, Agent, or Firm* — Standley Law Group LLP; Jeffrey Standley; Jeffrey Norris

(57) ABSTRACT

A panel comprised of at least one connector that facilitates connection with an adjacent panel. An exemplary embodiment of a panel may be comprised of a female connector and a male connector such that the male connector may be inserted in a female connector of an adjacent, substantially similar panel. The female connector may include a ridge, and the male connector may include a flange. An exemplary embodiment of a panel assembly may be formed when a male connector of one panel is inserted in a female connector of another panel such that the flange of the male connector slides over the ridge of the female connector to interlock the panels.

49 Claims, 5 Drawing Sheets

Related U.S. Application Data

(60) Provisional application No. 60/664,754, filed on Mar. 24, 2005.

(51) Int. Cl.

| | |
|---|---|
| ***E04C 2/38*** | (2006.01) |
| ***E04B 2/00*** | (2006.01) |
| ***E04F 13/07*** | (2006.01) |
| ***E04F 13/08*** | (2006.01) |
| ***E04H 17/16*** | (2006.01) |

(56) References Cited

U.S. PATENT DOCUMENTS

| | | | | |
|---|---|---|---|---|
| 5,247,770 | A | 9/1993 | Ting | |
| 5,295,341 | A * | 3/1994 | Kajiwara | 52/586.2 |
| 6,314,701 | B1 | 11/2001 | Meyerson | |
| 2002/0142135 | A1 | 10/2002 | Chen et al. | |
| 2004/0050007 | A1 | 3/2004 | Curatolo | |
| 2006/0251865 | A1 | 11/2006 | Hinterneder | |

OTHER PUBLICATIONS

LexisNexis, *Ex parte Daniel Christopher Berg, Charles Dyer Bridgham, and John David Lanuti*, Appeal 2009-007393, U.S. Appl. No. 10/999,337, Technology Center 2100, Board of Patent Appeals and Interferences, 2011 Pat. App. Lexis 20601, Jul. 8, 2011, Decided, Before Joseph L. Dixon, Howard B. Blankenship, and John A. Jeffery, Administrative Patent Judges., 3 pages.

LexisNexis, *Ex parte Michael J. Borsch, Steven R. Klassen, and Sanjiv Lakhanpal*, Appeal 2009-001137, U.S. Appl. No. 10/269,533, Technology Center 2800, Board of Patent Appeals and Interferences, 2010 Pat. App. Lexis 13388, Jun. 17, 2010, Decided, Before James D. Thomas, Joseph L. Dixon, and Lance Leonard Barry, Administrative Patent Judges., 6 pages.

LexisNexis, *Ex parte Darpan Dinker, Pramod Gopinath, and Mahesh Kannan*, Appeal 2009-007775, U.S. Appl. No. 10/281,543, Technology Center 2400, Board of Patent Appeals and Interferences, 2011 Pat. App. Lexis 15423, Feb. 2, 2011, Decided, Before Jay P. Lucas, John A. Jeffrey, and James R. Hughes, Administrative Patent Judges., 5 pages.

LexisNexis, *Gemtron Corporation*, Plaintiff-Appellee, v. *Saint-Gobain Corporation*, Defendant-Appellant, 2009-1001, United States Court of Appeals for the Federal Circuit, 2009 U.S. App. Lexis 15867; 91 U.S.P.Q.2D (BNA) 1409, Jul. 20, 2009, Decided, Analysis As of: Aug 27, 2009, 9 pages.

LexisNexis, *Ex parte Andrew D. Hirzel*, Appeal 2006-3366, U.S. Appl. No. 10/864,041, Technology Center 2800, Board of Patent Appeals and Interferences, 2007 Pat. App. Lexis 3388, Jul. 31, 2007, Decided, Before James D. Thomas, Joseph L. Dixon, and St. John Courtenay III, Administrative Patent Judges., 10 pages.

LexisNexis, in the Matter of the Application of J. William Venezia, Patent Appeal No. 75-601, United States Court of Customs and Patent Appeals, 530 F.2d 956; 1976 CCPA Lexis 186; 189 U.S.P.Q. (BNA) 149, Mar. 11, 1976, Decided, Positive As of: May 5, 2010, 4 pages.

LexisNexis, *Ex parte Orvalle Theodore Kirby, Gregory Michael Nordstrom, Gregory Francis Pfister, Renato John Recio, and Steven Mark Thurber*, Appeal 2008-002920, U.S. Appl. No. 09/692,365 nl, n1 Application filed Oct. 19, 2000. The real party in interest is International Business Machines Corporation, Technology Center 2100, Board of Patent Appeals and Interferences, 2009 Pat. App. Lexis 11051, May 29, 2009, Decided n2, Before Joseph L. Dixon, Jay P. Lucas, and Carolyn D. Thomas, Administrative Patent Judges., 8 pages.

LexisNexis, *Ex parte David Raymond Lutz and Christopher Neal Hinds*, Appeal 2010-001570, U.S. Appl. No. 10/999,154. Technology Center 2100, Board of Patent Appeals and Interferences, 2011 Pat. App. Lexis 15720, Mar. 30, 2011, Decided, Before Joseph L. Dixon, Lance Leonard Barry, and Carolyn D. Thomas, Administrative Patent Judges., 5 pages.

LexisNexis, *Ex parte Robert Miller*, Appeal 2008-005207, U.S. Appl. No. 09/732,189 n1, n1 Application filed Dec. 7, 2000. The real party in interest is International Business Machines Corporation., Technology Center 2400, Board of Patent Appeals and Interferences, 2009 Pat. App. Lexis 5865, Jul. 27, 2009, Decided n2, Before Lance Leonard Barry, Howard B. Blankenship, and Carolyn D. Thomas, Administrative Patent Judges., 6 pages.

LexisNexis, *Ex parte Roger Patrick and Phillip L. Jones*, Appeal No. 2005-0537, U.S. Apl. No. 08/925,985, Board of Patent Appeals and Interferences, 2005 Pat. App. Lexis 2291, Jun. 16, 2005, Decided, Before Kratz, Jeffrey T. Smith, and Pawlikowski, Administrative Patent Judges., 6 pages.

LexisNexis, in Re Arthur B. Steele, Jr., Edward J. Mills, Jr., and Donald G. Leis, No. 6719, United States Court of Customs and Patent Appeals, 49 C.C.P.A. 1295; 305 F.2d 859; 1962 CCPA Lexis 217; 134 U.S.P.Q. (BNA) 292, Oral arguments Oct. 11, 1961, Jul. 25, 1962, 5 pages.

LexisNexis, *Ex parte Jason L. Taylor, Abhijit Muthiyan, and Russ Thrasher*, Appeal 2009-002113, U.S. Appl. No. 10/229,539, Technology Center 2400, Board of Patent Appeals and Interferences, 2010 Pat. App. Lexis 17254, Aug. 3, 2010, Decided, Before John A. Jeffrey, Jean R. Homere, and Carolyn D. Thomas, Administrative Patent Judges., 8 pages.

LexisNexis, *Ex parte Shuwu Wu and James Crawford*, Appeal 2009-1204, U.S. Appl. No. 09/810,159, Technology Center 2400, Board of Patent Appeals and Interferences, 2009 Pat. App. Lexis 11416, May 4, 2009, Decided n1, Before Lee E. Barrett, Joseph L. Dixon, and Lance Leonard Barry, Administrative Patent Judges., 4 pages.

* cited by examiner

INTERLOCK PANEL, PANEL ASSEMBLY, AND METHOD FOR SHIPPING

This application is a continuation of U.S. patent application Ser. No. 11/388,775, filed Mar. 24, 2006, which claims the benefit of U.S. Provisional Application No. 60/664,754, filed Mar. 24, 2005, each of which is hereby incorporated by reference in its entirety.

BACKGROUND AND SUMMARY OF THE INVENTION

The present invention relates generally to panels. Panels are used in a variety of indoor and outdoor applications. For example, a panel or panel assembly may be used for a wall decoration or for a structural wall component. For another example, panels may be used to make railing or fences such as for protecting and securing people, animals, or land. Railing and fences may also be used to create privacy or to prevent entry into a predetermined area. For instance, fences may be used to contain livestock, pets, or children in a predetermined area or to prevent predators from entering into a predetermined area. In addition to these functional uses of panels, panels may also be used for decorative purposes such as on the interior of homes or around porches, decks, yards, gardens, and roads.

In light of the varied uses of panels, there is a need for an improved panel design that includes connectors to facilitate connection with adjacent panels. There is also a need for a panel assembly comprised of multiple panels that have been interconnected together. Furthermore, there is a need for improved methods of shipping and installing panels.

An exemplary embodiment of the present invention may address some or all of these needs. An exemplary embodiment of the present invention is a panel that includes at least one connector to facilitate connection with an adjacent panel. The improved design may enable multiple panels to be interconnected with a minimal amount of parts and labor in order to form a panel assembly. As a result, exemplary embodiments of the panel and panel assembly may facilitate the installation of fencing, railing, or other suitable applications of the panel. For example, panels may be interconnected at the manufacturing site to form a panel assembly, which may then be shipped as a unit to the installation site for easy installation. In addition to these benefits, exemplary embodiments of the panel and panel assembly may require a reduced amount of maintenance after installation, while still providing an aesthetically appealing appearance for fencing, railing, or other suitable applications.

In addition to the novel features and advantages mentioned above, other features and advantages of the present invention will be readily apparent from the following descriptions of the drawings and exemplary embodiments.

DETAILED DESCRIPTION OF EXEMPLARY EMBODIMENT(S)

Figure 1:
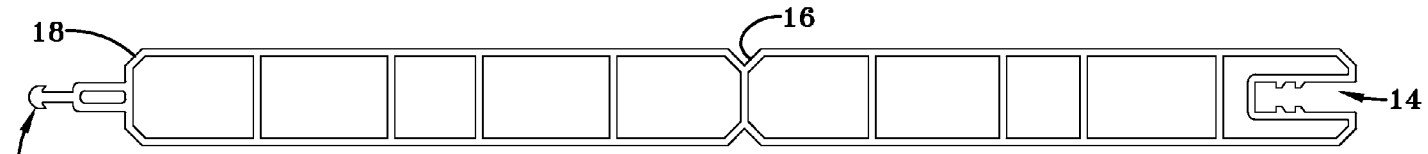
FIG. 1 is a top plan view of an exemplary embodiment of a panel of the present invention.
Figure 3:
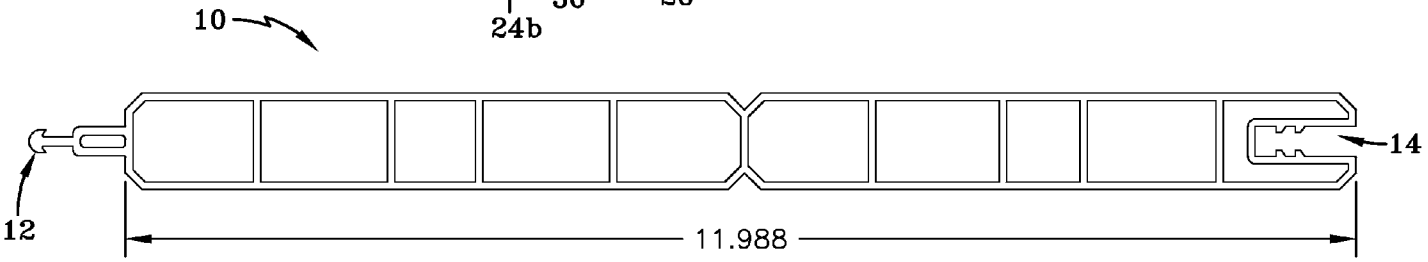
FIG. 3 is another top plan view of the panel of FIG. 1 with an exemplary dimension illustrated.

The present invention is directed to panels as well as assemblies and methods related to the panels. One exemplary embodiment of a panel of the present invention is shown in FIG. 1 and FIG. 3. The panel 10 is comprised of at least one connector for enabling connection with another panel. In this example, panel 10 is comprised of a male connector 12 and a female connector 14. Male connector 12 is adapted to be inserted into a female connector of another panel in order to connect adjacent panels. Similarly, female connector 14 is adapted to receive a male connector of another panel in order to connect adjacent panels. As a result, multiple panels may be interconnected to form a panel assembly. For optimum stability, it may be preferred that male connector 12 and female connector 14 enable adjacent panels to be interlocked together to form a panel assembly.

Figure 2:
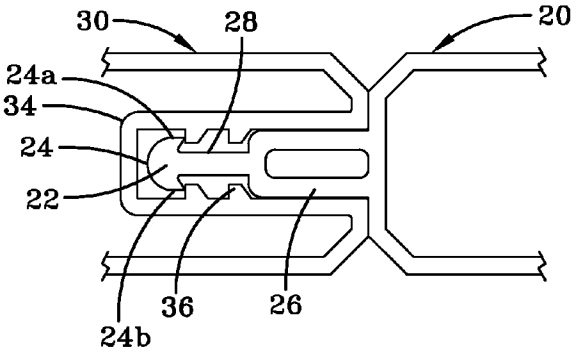
FIG. 2 is a fragmented, top plan view of an exemplary embodiment of interlocking panels of the present invention.

FIG. 2 shows an example of interlocked panels 20 and 30, each of which may be substantially similar to panel 10. In this example, male connector 22 of panel 20 is inserted into female connector 34 of panel 30 such that the panels are interlocked. Male connector 22 is generally shaped like an arrow in this exemplary embodiment. Other configurations of a male connector are also possible and considered within the scope of the present invention. As shown in the example in FIG. 2, male connector 22 has a tip 24. Tip 24 may be comprised of at least one flange. For example, tip 24 includes flange 24*a* and flange 24*b* in this embodiment. On the other hand, female connector 34 may be comprised of at least one ridge 36. More particularly, in this example, female connector 34 has four ridges 36 such that there are two ridges 36 protruding from each sidewall of female connector 34. Optionally, a ridge 36 protruding from one sidewall may be opposite another ridge 36 that protrudes from the other sidewall such as shown in this example. In order to facilitate an interlocking fit, tip 24 and ridges 36 may be contoured such that tip 24 may be pushed beyond ridges 36 in order to interlock the panels such as shown in FIG. 2. More particularly, flange 24*a* and flange 24*b* are adapted to slide over respective ridges 36 in order to reach an interlocking position such as shown in FIG. 2. Once interlocked, the contoured designs of tip 24 and ridges 36 preferably prevent tip 24 from reversing out of female connector 34 under normal use conditions, thereby providing a stable panel assembly. In order words, flange 24*a* and flange 24*b* preferably catch on ridges 36 if there is a force attempting to pull male connector 22 out of female connector 34. This type of fit between the panels may be referred to as an interference fit, which may also be known as a force fit or a press fit.

Male connector 22 may include additional features to enable a stable connection. For example, male connector 22 may have a base portion 26 and an extension portion or prong 28. In this exemplary embodiment, base portion 26 may have a sufficient width to provide a tight fit (e.g., a friction fit) with female connector 34 such as shown in FIG. 2. In addition, base portion 26 may have a sufficient length to substantially abut or be substantially adjacent to ridges 36, if desired, for optimum stability. As in this exemplary embodiment, base portion 26 may be hollow. However, it should be recognized that the base portion of the male connector may be solid in other exemplary embodiments of the present invention. On the other hand, extension portion 28 is adapted to extend from base portion 26 to tip 24. In other words, flange 24*a* and flange 24*b* extend from a tip of extension portion or prong 28 in this exemplary embodiment. However, in other exemplary embodiments, it should be recognized that at least one flange may optionally extend from an intermediate portion of a prong. For one example, although not shown in this embodiment, it should be recognized that extension portion 28 may be ribbed such that it also is adapted to be engaged by ridges 36. For example, a ribbed extension portion may also provide an interference fit with the female connector in other exemplary embodiments of the present invention.

Referring back to FIG. 1, panel 10 is a hollow panel with internal webbing. Nevertheless, it should be recognized that alternative embodiments of the panel may be solid (e.g., filled with a foam core). Panel 10 may also include at least one channel 16. Channel 16 may be used to promote the appearance of multiple planks. In addition, panel 10 may include angled edges 18. Such as shown in FIG. 2, the angled edges of adjacent panels may cooperate to form another channel similar to channel 16. As a result, the male and female connectors of adjacent panels may be hidden from view in an exemplary embodiment of the present invention, thereby providing a panel assembly having an aesthetically appealing appearance.

End caps may be used to provide an aesthetic and protective cover to the top and bottom ends of panel 10. The end caps may be secured by a friction fit or press fit with the hollow ends of panel 10, or by any other suitable connection means, such as screws, adhesives, clips, or other mechanical fastening means.

Figure 4:
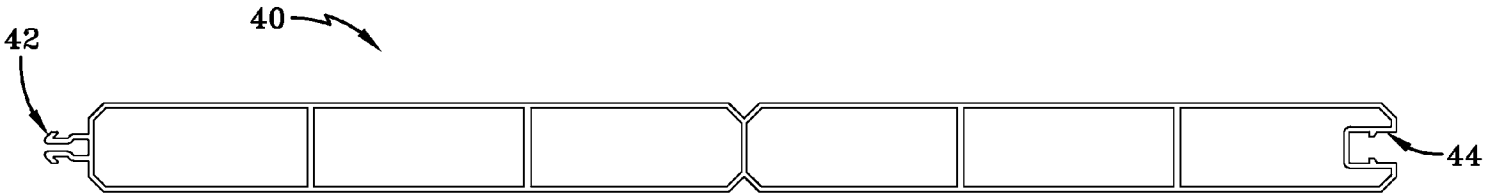
FIG. 4 is a top plan view of an exemplary embodiment of a panel of the present invention.

FIG. 4 shows another example of a panel of the present invention. Panel 40 may include any of the optional or preferred features of any of the previously described exemplary embodiments of the present invention. In this exemplary embodiment, panel 40 may be comprised of a male connector 42 and a female connector 44.

Figure 5:
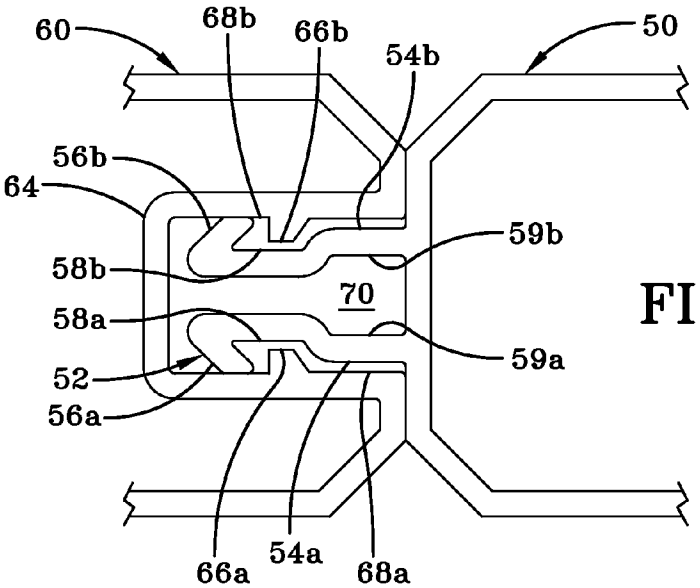
FIG. 5 is a fragmented, top plan view of an exemplary embodiment of interlocking panels of the present invention.
Figure 6:
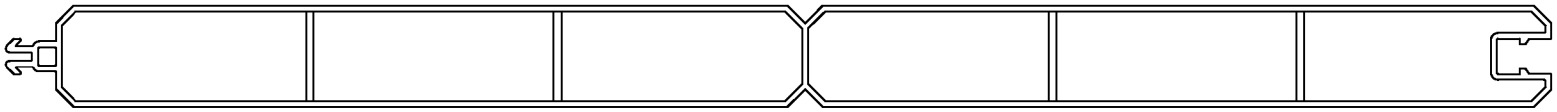
FIG. 6 is a top plan view of an exemplary embodiment of a panel of the present invention.

FIG. 5 shows an example of interlocked panels 50 and 60, each of which may be substantially similar to panel 40. In this example, male connector 52 of panel 50 is inserted into female connector 64 of panel 60 such that the panels are interlocked. Male connector 52 may be comprised of at least one prong or extension portion and at least one flange. As shown in the example in FIG. 5, this exemplary embodiment of male connector 52 may have a prong 54*a* and a prong 54*b*. Optionally, such as shown in this example, prong 54*a* may be a mirror image of prong 54*b*. At least one flange may extend from each prong. In this exemplary embodiment, flange 56*a* may extend from a tip of prong 54*a*, and flange 56*b* may extend from a tip prong 54*b*. In other exemplary embodiments, flange(s) may extend from any desired portion(s) (e.g., intermediate portions and/or the tip) of a prong. On the other hand, female connector 64 may be comprised of at least one ridge. More particularly, in this example, a ridge 66*a* protrudes from wall 68*a*, and a ridge 66*b* protrudes from wall 68*b*. Optionally, a ridge protruding from one wall may be opposite another ridge that protrudes from the other wall such as shown in this example. It is a further option that more that one ridge may protrude from a wall of a female connector. In order to facilitate an interlocking fit in this exemplary embodiment, flange 56*a* and ridge 66*a* may be contoured such that flange 56*a* may be pushed beyond or slide over ridge 66*a* in order to interlock the panels such as shown in FIG. 5. Similarly, flange 56*b* and ridge 66*b* may be contoured such that flange 56*b* may be pushed beyond or slide over ridge 66*b* in order to interlock the panels such as shown in FIG. 5 to further facilitate an interlocking connection between the panels. Once interlocked, the contoured designs of flange 56*a*, flange 56*b*, ridge 66*a*, and ridge 66*b* preferably prevent male connector 52 from reversing out of female connector 64 under normal use conditions such as previously described with regard to other embodiments.

A channel 70 may be provided between prong 54*a* and prong 54*b*. Channel 70 may facilitate the insertion of male connector 52 into female connector 64. In particular, channel 70 may enable prong 54*a* and prong 54*b* to flex toward each other, which facilitates sliding flange 56*a* over ridge 66*a* and flange 56*b* over ridge 66*b*.

As a further option, each prong may include a channel. Referring to FIG. 5, prong 54*a* includes a channel 58*a*, and prong 54*b* includes a channel 58*b*. Optionally, such as in this example, each channel may be situated immediately adjacent to the respective flange, and each channel may be recessed relative to a proximal portion of the respective prong. More particularly, in this example, channel 58*a* is recessed relative to proximal portion 59*a* and immediately adjacent to flange 56*a*, and channel 58*b* is recessed relative to proximal portion 59*b* and immediately adjacent to flange 56*b*. Other configurations of a channel of a prong are possible and considered to be within the scope of the present invention. As shown in FIG. 5, channel 58*a* may receive ridge 66*a* and channel 58*b* may receive ridge 66*b* when the panels are interlocked. As a result, these channels may optionally facilitate a snug and stable connection between the panels when interlocked.

Figure 7:
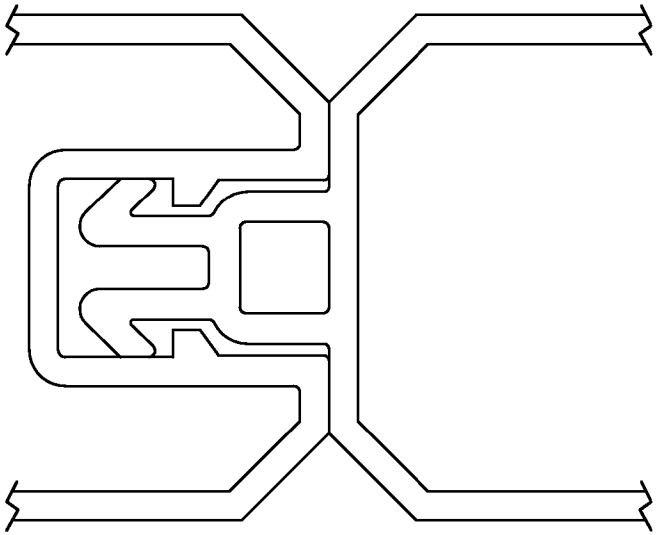
FIG. 7 is a fragmented, top plan view of an exemplary embodiment of interlocking panels of the present invention.
Figure 8:
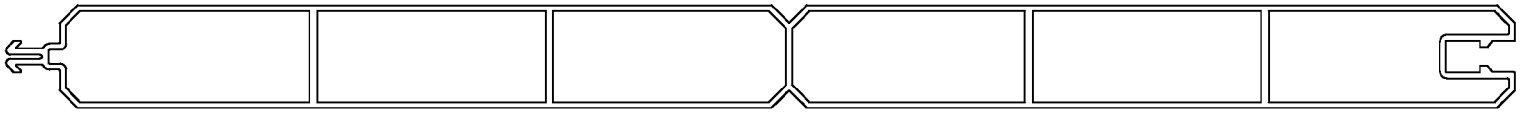
FIG. 8 is a top plan view of an exemplary embodiment of a panel of the present invention.
Figure 9:
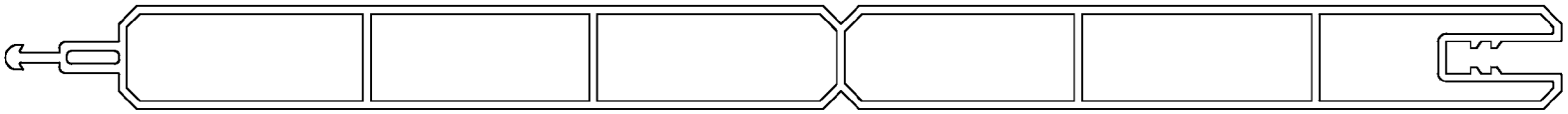
FIG. 9 is a top plan view of an exemplary embodiment of a panel of the present invention.
Figure 10:
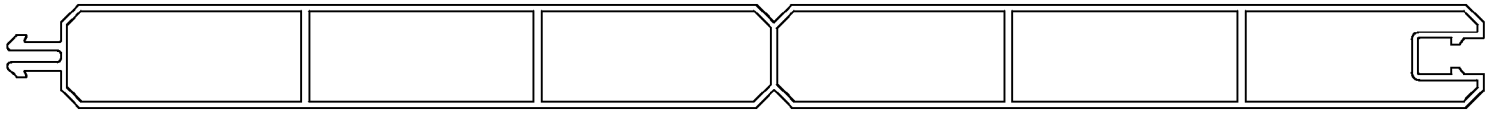
FIG. 10 is a top plan view of an exemplary embodiment of a panel of the present invention.
Figure 11:
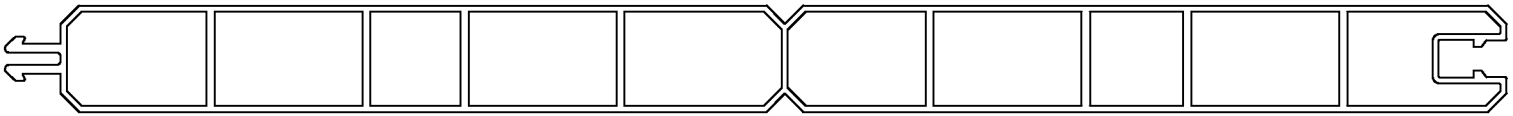
FIG. 11 is a top plan view of an exemplary embodiment of a panel of the present invention.
Figure 12:
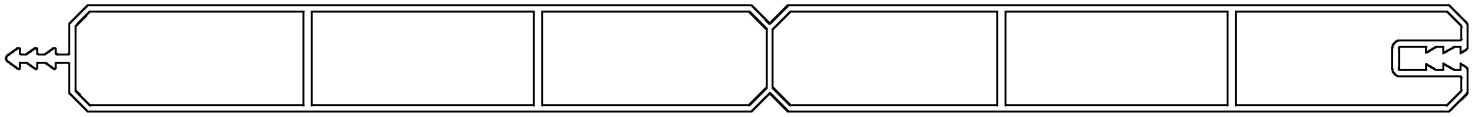
FIG. 12 is a top plan view of an exemplary embodiment of a panel of the present invention.
Figure 13:
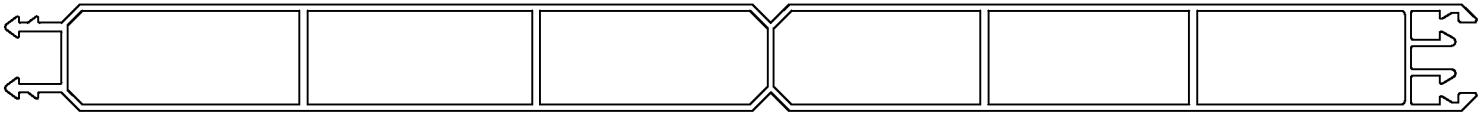
FIG. 13 is a top plan view of an exemplary embodiment of a panel of the present invention.

FIGS. 6 and 8 through 13 show additional exemplary embodiments of panels of the present invention. Each of these examples includes a variation of a male connector and/or a female connector. These exemplary panels may include any of the optional or preferred features of the other exemplary embodiments of the present invention. Furthermore, another example of an interlocking connection between panels is shown in FIG. 7.

The panels may be made from any suitable material. An exemplary material that may be used to make the panels is a polyvinyl chloride (PVC) or other vinyl material. Nevertheless, it should be recognized that other plastics may be used including, but not limited to, multilayer films, high density polyethylene (HDPE), polypropylene, low density polyethylene (LDPE), chlorinated polyvinyl chloride (CPVC), acrylonitrile butadiene styrene (ABS), ethyl-vinyl acetate (EVA), polystyrene, other similar copolymers, other similar, suitable, or conventional plastic materials, and formulations that incorporate any of the aforementioned polymers such as plastic composites. A panel of the present invention may also be made from other materials such as woods, metals, and other formable materials. In addition, it should be recognized that a panel of the present invention may have a capstock layer (e.g., a PVC capstock layer or another suitable capstock layer) for desired physical and aesthetic characteristics.

A variety of additive and fillers may be used to make an exemplary embodiment of a panel from a plastic compound or a plastic composite. Examples of optional additives and fillers include, but are not limited to, cellulosic fillers, polymers, plastics, thermoplastics, rubber, inorganic fillers, cross-linking agents, lubricants, process aids, stabilizers (e.g., thermal stabilizers and ultraviolet stabilizers), accelerators, inhibitors, enhancers, compatibilizers, blowing agents, foaming agents, thermosetting materials, colorants, and other similar, suitable, or conventional materials. Examples of cellulosic fillers include sawdust, newspapers, alfalfa, wheat pulp, wood chips, wood fibers, wood particles, ground wood, wood flour, flax, wood flakes, wood veneers, wood laminates, paper, cardboard, straw, cotton, rice hulls, coconut shells, peanut shells, bagass, plant fibers, bamboo fiber, palm fiber, kenaf, and other similar, suitable, or conventional materials. Any of the wood examples may be hard or soft wood or variations thereof. Furthermore, any desired mesh size of the cellulosic filler can be used. With regard to wood flour, an exemplary range of mesh size is about 10 to about 100 mesh, more preferably about 40 mesh to about 80 mesh depending on the desired characteristics of the composite. On the other hand, examples of polymers include multilayer films, high density polyethylene (HDPE), polypropylene, polyvinyl chloride (PVC), low density polyethylene (LDPE), chlorinated polyvinyl chloride (CPVC), acrylonitrile butadiene styrene (ABS), ethyl-vinyl acetate (EVA), polystyrene, other similar copolymers, other similar, suitable, or conventional plastic materials, and formulations that incorporate any of the aforementioned polymers. Examples of inorganic fillers include talc, calcium carbonate, kaolin clay, magnesium oxide, titanium dioxide, silica, mica, barium sulfate, and other similar, suitable, or conventional materials. Examples of thermosetting materials include polyurethanes, such as isocyanates, phenolic resins, unsaturated polyesters, epoxy resins, and other similar, suitable, or conventional materials. Combinations of the aforementioned materials are also examples of thermosetting materials. Examples of lubricants include zinc stearate, calcium stearate, esters, amide wax, paraffin wax, ethylene bis-stearamide, and other similar, suitable, or conventional materials. Examples of stabilizers include tin stabilizers, lead and metal soaps such as barium, cadmium, and zinc, and other similar, suitable, or conventional materials. In addition, examples of process aids include acrylic modifiers and other similar, suitable, or conventional materials. Furthermore, a foaming agent can be an exothermic or endothermic foaming agent. An example of an exothermic foaming agent is azodicarbonamide, and an example of an endothermic foaming agent is sodium bicarbonate. Thus, in light of these possible ingredients, examples of plastic composites include, but are not limited to, polymer/cellulosic filler composites, thermoplastic/cellulosic filler composites, thermoset plastic/cellulosic filler composites, rubber/cellulosic filler composites, foamed cellulosic-filled plastic composites, and other suitable plastic composites.

A panel of the present invention may be formed by any suitable method. For example, a panel may be made by extrusion, compression molding, injection molding, or any other suitable technique. In one preferred embodiment of the present invention, the panels may be extruded and cut to the desired length. The panels may then be gathered and racked such as by a mechanical arm or other gathering device. An automated machine such as an air-actuated jig or a press machine may then snap or press the panels together to form a panel assembly. As a result, this process enables the automated production of panel assemblies at the manufacturing site. Nevertheless, it should be recognized that non-automated or partially automated processes may also be used to produce panel assemblies of the present invention at the manufacturing site. Regardless of the particular method of producing the panel assembly at the manufacturing site, the panel assembly may be shipped as a single unit from the manufacturing site to the installation site, where it may be connected with other similar panel assemblies or other components in order to form a fence, a rail, or any other desired type of structure or decoration. As a result, these exemplary methods of shipping and installing a panel assembly may greatly reduce the assembly time at the installation site as well as limit the possibility of improper installation.

A panel of the present invention may have any desired dimensions. For example, FIG. 3 shows an example of panel 10 in which the body has a width of about 12 inches. Other narrower or wider widths are possible. In addition, a panel of the present invention may have any desired length. For example, a panel of the present invention may be used for a relatively short rail or flower garden fence or for a relatively tall border fence. Of course, other shorter or taller lengths are possible and may be selected to suit a particular use of the panel.

A panel assembly of the present invention may include any desired number of panels. Furthermore, a panel assembly may have any desired width (where width is measured in the same direction as the width of an individual panel. Using the example of FIG. 3, six panels may be interconnected to form a panel assembly that is about six feet wide, or eight panels may be interconnected to form a panel assembly that is about eight feet wide. Of course, as mentioned above, other narrower or wider widths are possible.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the present invention. It is the intention, therefore, to limit the invention only as indicated by the scope of the claims.

What is claimed is:

1. A panel comprising:

a female connector; and a male connector adapted to be inserted in a female connector of an adjacent, substantially similar panel to interconnect said panels, said male connector comprising:

a first prong comprising a first side portion having a first proximal portion that is straight and extends distally away from a point of attachment to said panel and a first recessed channel having a portion that is straight and extends distally along said first prong, said first recessed channel relative to and adjoining said first proximal portion such that said first proximal portion is substantially parallel to said first recessed channel portion; and a second prong comprising a second side portion having a second proximal portion and a second recessed channel relative to and adjoining said second proximal portion;

wherein said first proximal portion is spaced a first distance from said second proximal portion, said first recessed channel is spaced a second distance from said second recessed channel, and said first distance is greater than said second distance; and wherein said first recessed channel is configured to receive a first portion of said female connector of said adjacent, substantially similar panel and said second recessed channel is configured to receive a second portion of said female connector of said adjacent, substantially similar panel to facilitate interconnection of said panels.

2. The panel of claim 1 wherein said second proximal portion is substantially parallel to said second recessed channel.

3. The panel of claim 1 wherein:

said male connector further comprises a first flange extending from said first side portion of said first prong; and said female connector comprises a first ridge.

4. The panel of claim 3 wherein said first flange of said male connector is adapted to be pushed beyond or slid over a first ridge of said female connector of said adjacent, substantially similar panel when said male connector is inserted in said female connector of said adjacent, substantially similar panel such that said first recessed channel of said male connector is adapted to receive said first ridge of said female connector of said adjacent, substantially similar panel.

5. The panel of claim 3 wherein said male connector and said female connector are sufficiently flexible such that said first flange of said male connector is adapted to be pushed beyond or slid over a first ridge of said female connector of said adjacent, substantially similar panel when said male connector is inserted in said female connector of said adjacent, substantially similar panel in an insertion direction to lock said panels together in a press fit such that said male connector is adapted to resist being withdrawn from said female connector of said adjacent, substantially similar panel in a direction opposite said insertion direction.

6. The panel of claim 1 wherein said female connector further comprises:

a first ridge;

a first wall from which said first ridge protrudes;

a second wall opposite said first wall; and a second ridge protruding from said second wall.

7. The panel of claim 6 wherein said first ridge is opposite said second ridge.

8. The panel of claim 6 wherein said male connector further comprises:

a first flange that extends from said first side portion of said first prong; and a second flange that extends from said second side portion of said second prong;

wherein said first flange of said male connector is adapted to be pushed beyond or slid over a first ridge of said female connector of said adjacent, substantially similar panel and said second flange of said male connector is adapted to be pushed beyond or slid over a second ridge of said female connector of said adjacent, substantially similar panel when said male connector is inserted in said female connector of said adjacent, substantially similar panel in an insertion direction to assist with locking said panels together in a press fit such that said male connector is adapted to resist being withdrawn from said female connector of said adjacent, substantially similar panel in a direction opposite said insertion direction.

9. The panel of claim 8 wherein said male connector further comprises:

a channel formed between said first prong and said second prong;

wherein said first prong and said second prong are adapted to flex toward each other when said first flange and said second flange are pushed beyond or slid over said first ridge and said second ridge, respectively, of said female connector of said adjacent, substantially similar panel when said male connector is inserted in said female connector of said adjacent, substantially similar panel in said insertion direction.

10. The panel of claim 8 wherein:

said first flange extends from a tip of said first side portion of said first prong; and said second flange extends from a tip of said second side portion of said second prong.

11. The panel of claim 8 wherein said male connector is adapted to slide relative to said female connector of said adjacent, substantially similar panel in a direction perpendicular to said insertion direction in order to unlock said panels.

12. The panel of claim 1 wherein said first side portion is substantially parallel to said second side portion.

13. The panel of claim 1 wherein:

said male connector further comprises a first flange extending from said first side portion of said first prong; and said first recessed channel is immediately adjacent said first flange of said male connector.

14. A panel comprising:

a female connector; and a male connector adapted to be inserted in a female connector of an adjacent, substantially similar panel to interconnect said panels, said male connector comprising:

a first prong comprising a first side portion having a first proximal portion that is straight and extends distally away from a point of attachment to said panel and a first recessed channel having a portion that is straight and extends distally along said first prong, said first recessed channel relative to and adjoining said first proximal portion such that said first proximal portion is substantially parallel to said first recessed channel portion; and a second prong comprising a second side portion having a second proximal portion and a second recessed channel relative to and adjoining said second proximal portion, said second side portion of said second prong substantially parallel to said first side portion of said first prong;

wherein said first proximal portion is spaced a first distance from said second proximal portion, said first recessed channel is spaced a second distance from said second recessed channel, and said first distance is greater than said second distance; and wherein said first recessed channel is configured to receive a first portion of said female connector of said adjacent, substantially similar panel and said second recessed channel is configured to receive a second portion of said female connector of said adjacent, substantially similar panel to facilitate interconnection of said panels.

15. The panel of claim 14 wherein:

said female connector comprises:

a first ridge on a first wall; and a second ridge on a second wall;

said male connector comprises:

a first flange extending from said first side portion of said first prong; and a second flange extending from said second side portion of said second prong;

wherein said first flange and said second flange of said male connector are adapted to be pushed beyond or slid over a first ridge and a second ridge, respectively, of said female connector of said adjacent, substantially similar panel when said male connector is inserted in said female connector of said adjacent, substantially similar panel such that said first recessed channel and said second recessed channel of said male connector are adapted to receive said first ridge and said second ridge, respectively, of said female connector of said adjacent, substantially similar panel.

16. The panel of claim 15 wherein:

said first flange extends from a tip of said first prong of said male connector; and said second flange extends from a tip of said second prong of said male connector.

17. The panel of claim 15 wherein:

said first recessed channel is immediately adjacent said first flange of said male connector; and said second recessed channel is immediately adjacent said second flange of said male connector.

18. The panel of claim 14 wherein:

said male connector further comprises a first flange extending from said first side portion of said first prong; and said female connector comprises a first ridge.

19. The panel of claim 18 wherein said first flange of said male connector is adapted to be pushed beyond or slid over a first ridge of said female connector of said adjacent, substantially similar panel when said male connector is inserted in said female connector of said adjacent, substantially similar panel such that said first recessed channel of said male connector is adapted to receive said first ridge of said female connector of said adjacent, substantially similar panel.

20. The panel of claim 18 wherein said male connector and said female connector are sufficiently flexible such that said first flange of said male connector is adapted to be pushed beyond or slid over a first ridge of said female connector of said adjacent, substantially similar panel when said male connector is inserted in said female connector of said adjacent, substantially similar panel in an insertion direction to lock said panels together in a press fit such that said male connector is adapted to resist being withdrawn from said female connector of said adjacent, substantially similar panel in a direction opposite said insertion direction.

21. The panel of claim 14 wherein said female connector further comprises:

a first ridge;

a first wall from which said first ridge protrudes;

a second wall opposite said first wall; and a second ridge protruding from said second wall.

22. The panel of claim 21 wherein said first ridge is opposite said second ridge.

23. The panel of claim 21 wherein said male connector further comprises:

a first flange that extends from said first side portion of said first prong; and a second flange that extends from said second side portion of said second prong;

wherein said first flange of said male connector is adapted to be pushed beyond or slid over a first ridge of said female connector of said adjacent, substantially similar panel and said second flange of said male connector is adapted to be pushed beyond or slid over a second ridge of said female connector of said adjacent, substantially similar panel when said male connector is inserted in said female connector of said adjacent, substantially similar panel in an insertion direction to assist with locking said panels together in a press fit such that said male connector is adapted to resist being withdrawn from said female connector of said adjacent, substantially similar panel in a direction opposite said insertion direction.

24. The panel of claim 23 wherein said male connector further comprises:

a channel formed between said first prong and said second prong;

wherein said first prong and said second prong are adapted to flex toward each other when said first flange and said second flange are pushed beyond or slid over said first ridge and said second ridge, respectively, of said female connector of said adjacent, substantially similar panel when said male connector is inserted in said female connector of said adjacent, substantially similar panel in said insertion direction.

25. The panel of claim 23 wherein:

said first flange extends from a tip of said first side portion of said first prong; and said second flange extends from a tip of said second side portion of said second prong.

26. The panel of claim 23 wherein said male connector is adapted to slide relative to said female connector of said adjacent, substantially similar panel in a direction perpendicular to said insertion direction in order to unlock said panels.

27. The panel of claim 14 wherein:

said male connector further comprises a first flange extending from said first side portion of said first prong; and said first recessed channel is immediately adjacent said first flange of said male connector.

28. A panel comprising:

a female connector; and a male connector adapted to be inserted in a female connector of an adjacent, substantially similar panel to interconnect said panels, said male connector comprising:

a first prong comprising a first side portion having a first proximal portion that is straight and extends distally away from a point of attachment to said panel and a first recessed portion having a portion that is straight and extends distally along said first prong, said first recessed portion relative to and adjoining said first proximal portion; and a second prong comprising a second side portion having a second proximal portion that is straight and extends distally away from a point of attachment to said panel and a second recessed portion having a portion that is straight and extends distally along said second prong, said second recessed portion relative to and adjoining said second proximal portion;

wherein said first proximal portion is spaced a first distance from said second proximal portion, said first recessed portion is spaced a second distance from said second recessed portion, and said first distance is greater than said second distance;

wherein said first proximal portion is substantially parallel to said second proximal portion and said portion of said first recessed portion is substantially parallel to said portion of said second recessed portion; and wherein said first recessed portion is configured to receive a first portion of said female connector of said adjacent, substantially similar panel and said second recessed portion is configured to receive a second portion of said female connector of said adjacent, substantially similar panel to facilitate interconnection of said panels.

29. The panel of claim 28 wherein:

said first proximal portion is substantially parallel to said portion of said first recessed portion; and said second proximal portion is substantially parallel to said portion of said second recessed portion.

30. The panel of claim 28 wherein:

said male connector further comprises a first flange extending from said first side portion of said first prong; and said female connector comprises a first ridge.

31. The panel of claim 30 wherein said first flange of said male connector is adapted to be pushed beyond or slid over a first ridge of said female connector of said adjacent, substantially similar panel when said male connector is inserted in said female connector of said adjacent, substantially similar panel such that said first recessed portion of said male connector is adapted to be adjacent said first ridge of said female connector of said adjacent, substantially similar panel.

32. The panel of claim 30 wherein said male connector and said female connector are sufficiently flexible such that said first flange of said male connector is adapted to be pushed beyond or slid over a first ridge of said female connector of said adjacent, substantially similar panel when said male connector is inserted in said female connector of said adjacent, substantially similar panel in an insertion direction to lock said panels together in a press fit such that said male connector is adapted to resist being withdrawn from said female connector of said adjacent, substantially similar panel in a direction opposite said insertion direction.

33. The panel of claim 28 wherein said female connector further comprises:

a first ridge;

a first wall from which said first ridge protrudes;

a second wall opposite said first wall; and a second ridge protruding from said second wall.

34. The panel of claim 33 wherein said first ridge is opposite said second ridge.

35. The panel of claim 33 wherein said male connector further comprises:

a first flange that extends from said first side portion of said first prong; and a second flange that extends from said second side portion of said second prong;

wherein said first flange of said male connector is adapted to be pushed beyond or slid over a first ridge of said female connector of said adjacent, substantially similar panel and said second flange of said male connector is adapted to be pushed beyond or slid over a second ridge of said female connector of said adjacent, substantially similar panel when said male connector is inserted in said female connector of said adjacent, substantially similar panel in an insertion direction to assist with locking said panels together in a press fit such that said male connector is adapted to resist being withdrawn from said female connector of said adjacent, substantially similar panel in a direction opposite said insertion direction.

36. The panel of claim 35 wherein said male connector further comprises:

a portion formed between said first prong and said second prong;

wherein said first prong and said second prong are adapted to flex toward each other when said first flange and said second flange are pushed beyond or slid over said first ridge and said second ridge, respectively, of said female connector of said adjacent, substantially similar panel when said male connector is inserted in said female connector of said adjacent, substantially similar panel in said insertion direction.

37. The panel of claim 35 wherein:

said first flange extends from a tip of said first side portion of said first prong; and said second flange extends from a tip of said second side portion of said second prong.

38. The panel of claim 35 wherein said male connector is adapted to slide relative to said female connector of said adjacent, substantially similar panel in a direction perpendicular to said insertion direction in order to unlock said panels.

39. The panel of claim 28 wherein:

said male connector further comprises a first flange extending from said first side portion of said first prong; and said first recessed portion is immediately adjacent said first flange of said male connector.

40. A panel comprising:

a female connector comprising:

a first wall;

a second wall opposite said first wall;

a first ridge protruding from said first wall; and a second ridge protruding from said second wall; and a male connector adapted to be inserted in a female connector of an adjacent, substantially similar panel, said male connector comprising:

a first prong comprising a first side portion having a first proximal portion that is straight and extends distally away from a point of attachment to said panel and a first recessed portion having a portion that is straight and extends distally along said first prong, said first recessed portion relative to and adjoining said first proximal portion;

a second prong comprising a second side portion having a second proximal portion that is straight and extends distally away from a point of attachment to said panel and a second recessed portion having a portion that is straight and extends distally along said second prong, said second recessed portion relative to and adjoining said second proximal portion;

a first flange extending from said first side portion of said first prong; and a second flange extending from said second side portion of said second prong;

wherein said first proximal portion is spaced a first distance from said second proximal portion, said first recessed portion is spaced a second distance from said second recessed portion, and said first distance is greater than said second distance;

wherein said first proximal portion is substantially parallel to said second proximal portion and said portion of said first recessed portion is substantially parallel to said portion of said second recessed portion;

wherein said first wall of said female connector is substantially parallel to said first proximal portion of said male connector;

wherein said second wall of said female connector is substantially parallel to said second proximal portion of said male connector; and wherein said first flange and said second flange of said male connector are adapted to be pushed beyond or slid over a first ridge and a second ridge, respectively, of said female connector of said adjacent, substantially similar panel when said male connector is inserted in said female connector of said adjacent, substantially similar panel such that said first recessed portion and said second recessed portion of said male connector are adapted to receive and be adjacent said first ridge and said second ridge, respectively, of said female connector of said adjacent, substantially similar panel.

41. The panel of claim 40 wherein:

said first proximal portion is substantially parallel to said portion of said first recessed portion; and said second proximal portion is substantially parallel to said portion of said second recessed portion.

42. The panel of claim 40 wherein said second side portion of said second prong is substantially parallel to said first side portion of said first prong.

43. The panel of claim 40 wherein said male connector further comprises:

a portion formed between said first prong and said second prong;

wherein said first prong and said second prong are adapted to flex toward each other when said first flange and said second flange are pushed beyond or slid over said first ridge and said second ridge, respectively, of said female connector of said adjacent, substantially similar panel when said male connector is inserted in said female connector of said adjacent, substantially similar panel.

44. The panel of claim 40 wherein:

said first flange extends from a tip of said first prong of said male connector; and said second flange extends from a tip of said second prong of said male connector.

45. The panel of claim 44 wherein:

said first recessed portion is immediately adjacent said first flange; and said second recessed portion is immediately adjacent said second flange.

46. The panel of claim 40 wherein said male connector and said female connector are sufficiently flexible such that said male connector is adapted to be inserted in said female connector of said adjacent, substantially similar panel in an insertion direction to lock said panels together in a press fit such that said male connector is adapted to resist being withdrawn from said female connector of said adjacent, substantially similar panel in a direction opposite said insertion direction.

47. The panel of claim 46 wherein said male connector is adapted to slide relative to said female connector of said adjacent, substantially similar panel in a direction perpendicular to said insertion direction in order to unlock said panels.

48. The panel of claim 40 wherein:

said first ridge is remote from a first leading edge of said female connector; and said second ridge is remote from a second leading edge of said female connector.

49. The panel of claim 40 wherein said first ridge is opposite said second ridge.

* * * * *